United States Patent [19]

Tomita

[11] Patent Number: 4,769,553

[45] Date of Patent: Sep. 6, 1988

[54] STARTING SYSTEM FOR A SMALL ENGINE

[75] Inventor: Hiroshi Tomita, Numazu, Japan

[73] Assignee: Fuji Robin Kabushiki Kaisha, Tokyo, Japan

[21] Appl. No.: 130,853

[22] Filed: Dec. 8, 1987

[30] Foreign Application Priority Data

| | | | |
|---|---|---|---|
| Jul. 21, 1987 | [JP] | Japan | 62-181997 |
| Aug. 5, 1987 | [JP] | Japan | 62-120731[U] |
| Aug. 5, 1987 | [JP] | Japan | 62-120732[U] |
| Aug. 5, 1987 | [JP] | Japan | 62-120733[U] |

[51] Int. Cl.[4] ..... F02N 11/00

[52] U.S. Cl. ..... 290/38 E; 290/48

[58] Field of Search ..... 290/38 R, 38 C, 38 E, 290/48, DIG. 1, DIG. 3; 123/179 C

[56] References Cited

U.S. PATENT DOCUMENTS

| | | | |
|---|---|---|---|
| 1,617,775 | 2/1927 | Starkey | 290/DIG. 1 |
| 1,633,925 | 6/1927 | Chryst | 290/DIG. 1 |
| 1,962,252 | 6/1934 | McGrath | 290/38 E |
| 2,556,063 | 6/1951 | Buxton | 290/38 R |
| 4,507,565 | 3/1985 | Hamano | 290/48 X |

FOREIGN PATENT DOCUMENTS 58-178467 11/1983 Japan .

*Primary Examiner*—William M. Shoop, Jr.
*Assistant Examiner*—W. E. Duncanson, Jr.
*Attorney, Agent, or Firm*—Armstrong, Nikaido, Marmelstein & Kubovcik

[57] ABSTRACT

A starting motor is securely mounted in a holder rotatably mounted on a shaft, a pinion is secured to an output shaft of a starting motor in the holder. The holder is arranged to be rotated by an operator through a start lever from a home position to a starting position so as to engage the pinion with a ring gear securely mounted on a crankshaft. A pair of contacts are provided on the holder, and a contact is provided on the start lever so as to engage with the former contacts. The holder and the start lever are arranged to engage the latter contact with the former contacts when the holder is at the starting position and the start lever is returned to the home position to close an engine starting circuit, so that the starting motor is driven to start the engine.

7 Claims, 11 Drawing Sheets

STARTING SYSTEM FOR A SMALL ENGINE

BACKGROUND OF THE INVENTION

The present invention relates to a system for starting a small engine by means of a starting-motor.

Japanese Utility Model Laid Open No. 58-178467 discloses a starting-motor device for starting an engine.

The starting-motor has an idler gear mounted on a swing arm and engaged with a driving pinion, and adapted to be engaged with a ring gear, and has an overrunning-clutch mounted on a shaft of the motor so as to rotate the ring gear through the driving pinion and the idler gear. However, the starting-motor device is large in size because of the idler gear device. Accordingly, the device is not available to a small engine mounted on a small machine such as a portable bush and grass cutter and a chain saw.

SUMMARY OF THE INVENTION

An object of the present invention is to provide a system for starting a small engine which has small size.

Another object of the present invention is to provide a safety system for the starting system which inhibits the operation of the starting system after the start of the engine.

According to the present invention, there is provided a starting system for an engine having a ring gear securely mounted on a crankshaft, comprising a holder rotatably mounted on a shaft, a starting motor securely mounted in the holder, a pinion secured to an output shaft of the starting motor, a start lever rotatably mounted on the shaft, the holder being arranged to be rotated by an operator through the start lever, from a home position to a starting position so as to engage the pinion with the ring gear.

The system further comprises means for resiliently holding the holder at the home position and the starting position, a pair of first contacts provided on the holder, a third contact provided on the start lever so as to engage with the first contacts, an engine starting circuit including the first and third contacts, for connecting the motor with a source.

The holder and the start lever are so arranged as to engage the third contact with the first contacts when the holder is at the starting position and the start lever is returned to the home position to close the engine starting circuit. Thus the starting motor is driven to start the engine.

In an aspect of the invention, the means is a first spring provided between the holder and a fixed position of a member of the engine, the first spring is arranged to urge the holder to the home position and to the starting position on both sides of a neutral line connecting the fixed position and the axis of the shaft.

The system further comprises a second spring for urging the start lever to the home position, and a safety device having a stopper provided to project to obstruct a course of the start lever to the starting position. The safety device has a spring for urging the stopper to an obstructing position, and slants formed on the stopper and the start lever so as to permit the start lever to return to the home position.

In another embodiment of the invention, the safety device has a solenoid which is energized by a current for an ignition system of the engine to project the stopper in the course.

The system further comprises a second contact provided on the holder to engage with the third contact together with one of the first contacts when the holder and start lever are at the home position, thereby providing a regenerative braking circuit for the starting motor.

The other objects and features of this invention will be apparently understood from the following description with reference to the accompanying drawings.

DETAILED DESCRIPTION OF THE PREFERRED EMBODIMENT

Figure 1:
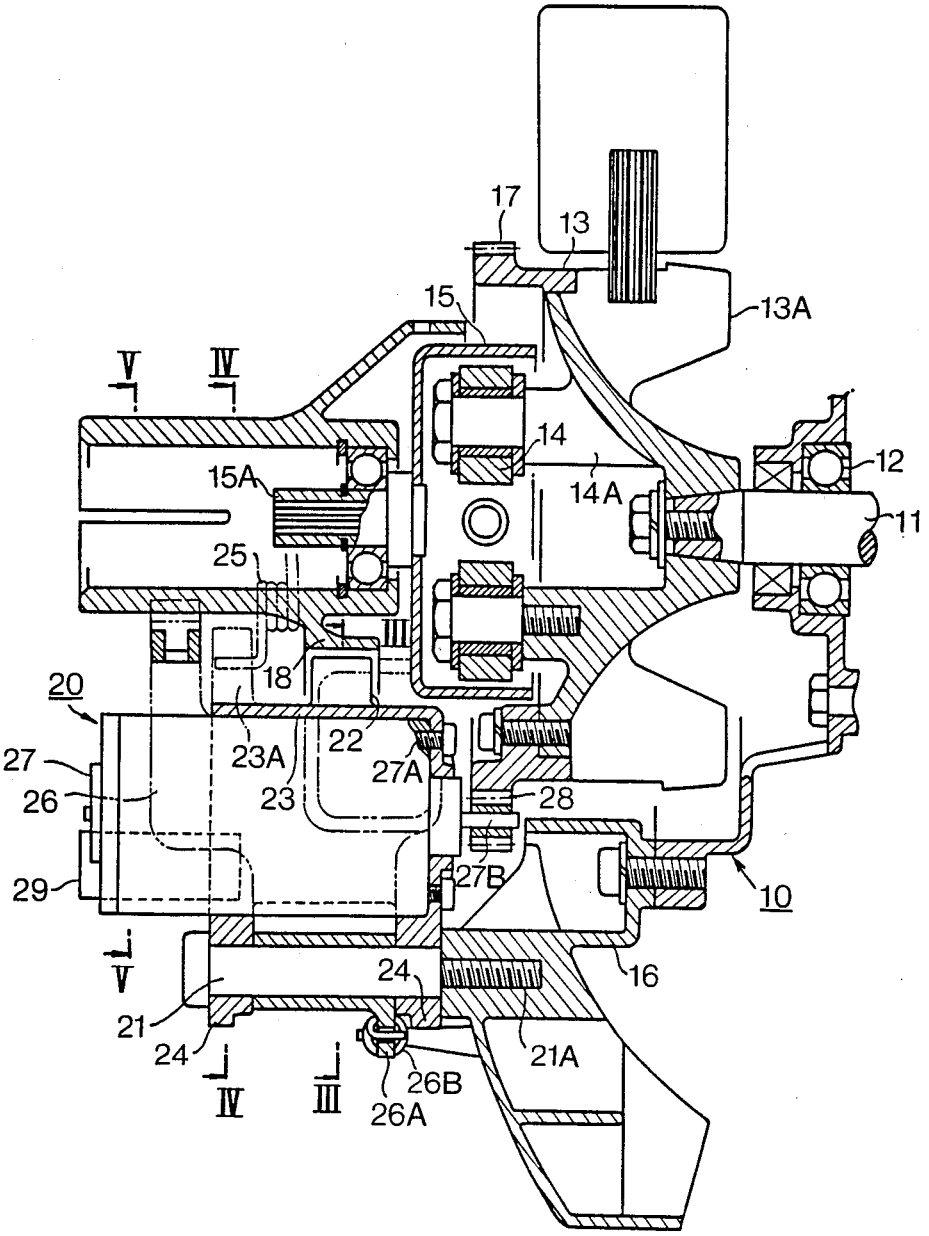
FIG. 1 is a sectional view showing a starting device used in a starting system of the present invention.
Figure 2:
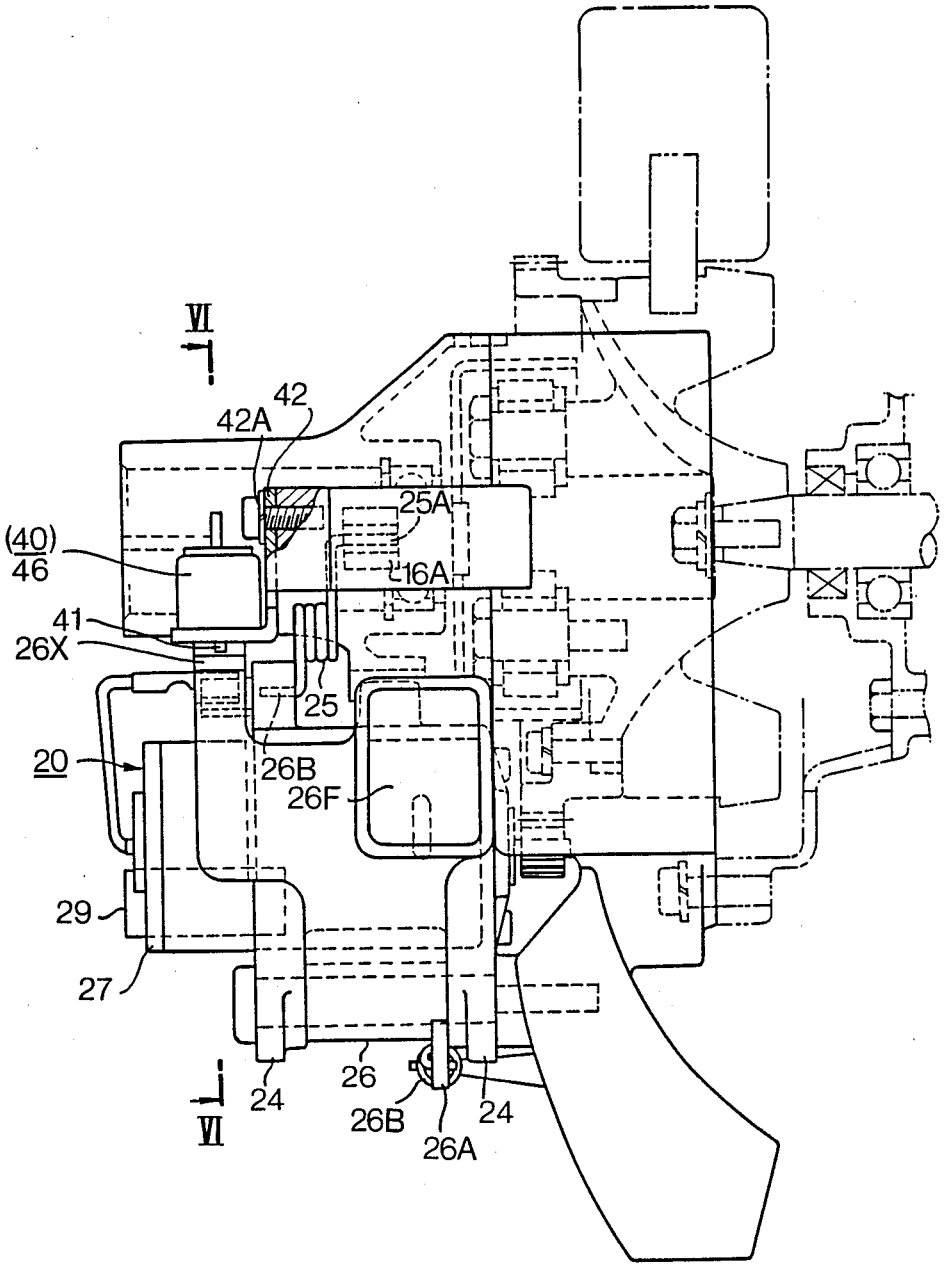
FIG. 2 is a side view of a starting-motor.

Referring to FIG. 1, a crankshaft 11 of an engine is rotatably supported in a casing 10 of the engine by a bearing 12 and a cooling fan 13 having blades l3A is secured to an end of the crankshaft 11. Clutch shoes 14 of a centrifugal clutch are mounted on brackets 14A formed on the fan 13. A clutch drum 15 rotatably mounted in a clutch housing 16 and having an output shaft 15A is provided around the clutch shoes 14. A ring gear 17 is formed on the periphery of the fan 13.

Figure 3:
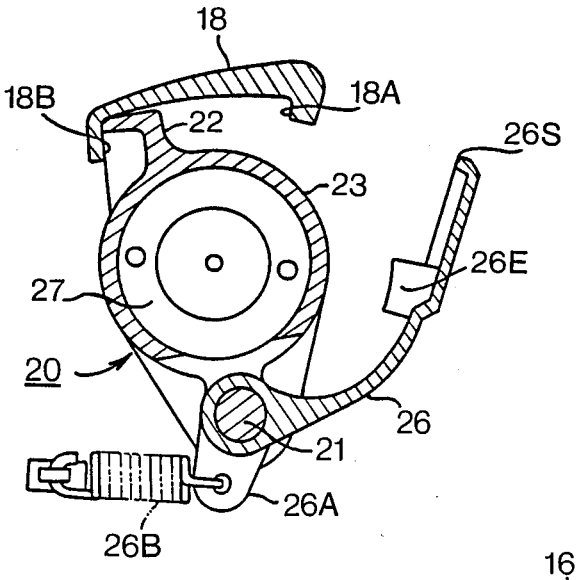
FIG. 3 is a sectional view taken along a line III—III of FIG. 1.

A self-starting motor unit 20 is rotatably mounted on a lower portion of the clutch housing 16 by a pivotal shaft 21 which is parallel with the axis of the crankshaft 11, so that the starting-motor unit 20 is rotated in a plane perpendicular to the crankshaft. The shaft 21 is rotatably engaged with a pair of flanges 24 of a cylindrical holder 23 for the unit 20 and secured to the housing 16 by a thread 21A formed on an end thereof. As shown is FIG. 3, the holder 23 has a projection 22 which is located in a swing limiting frame 18 formed on the housing, so that the swing of the holder 23 can be rotated within a range between stoppers 18A and 18B at both ends of the frame 18, with respect to a neutral line P—P of FIG. 4.

Figure 4:
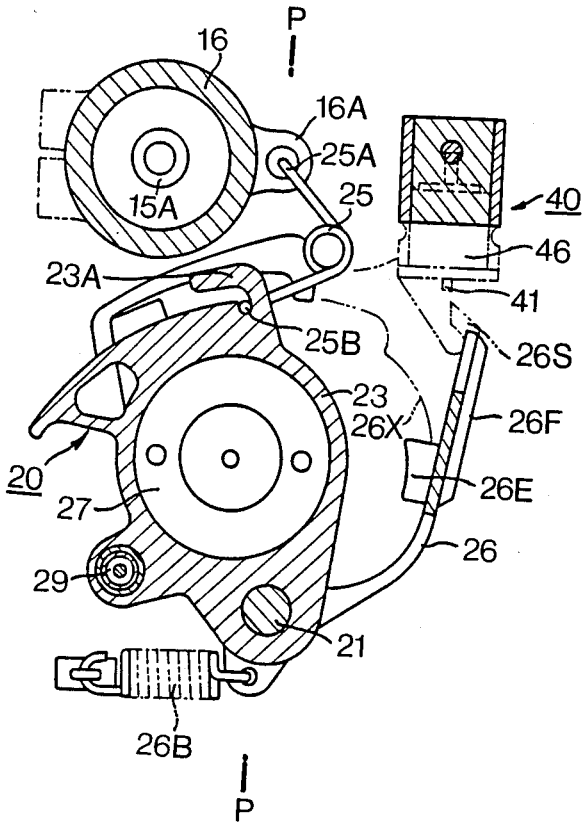
FIG. 4 is a sectional view taken along a line IV—IV of FIG. 1.
Figure 5:
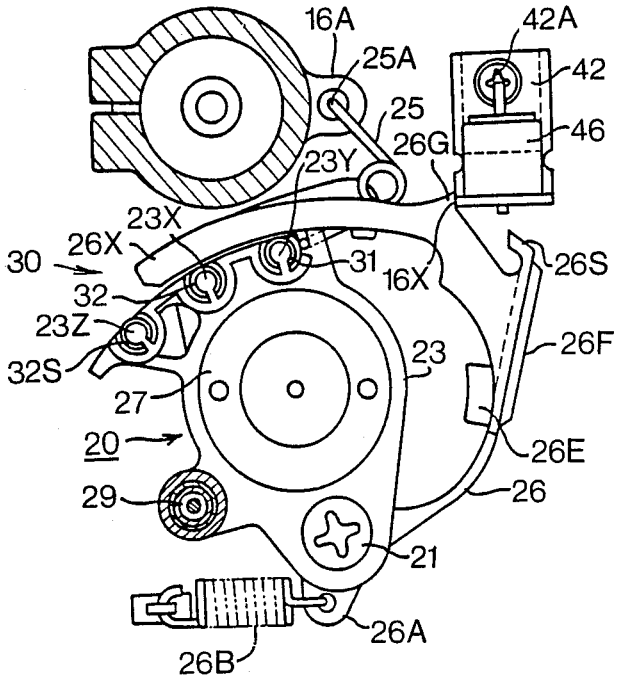
FIG. 5 is a sectional view taken along a line V—V of FIG. 1.
Figure 6:
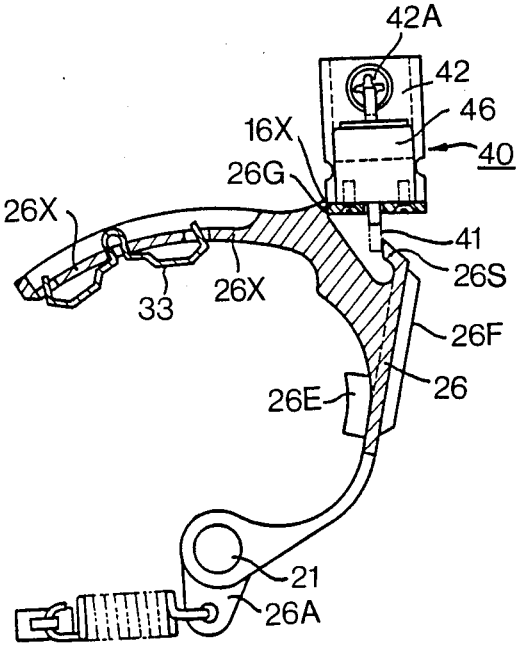
FIG. 6 is a sectional view taken along a line VI—VI of FIG. 2.
Figure 7:
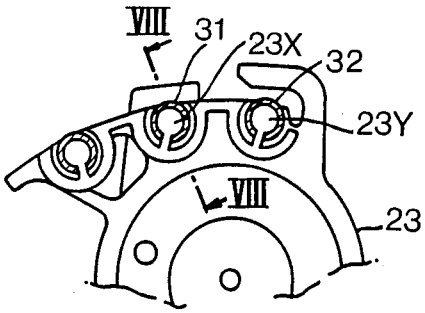
FIG. 7 is a sectional view taken along a line VII—VII of FIG. 2.
Figure 8:
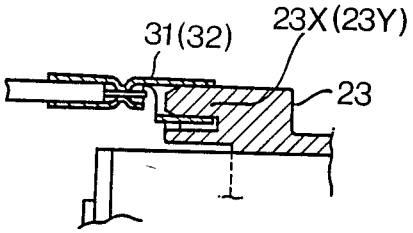
FIG. 8 is a sectional view taken along a line VIII—VIII of FIG. 7.

As shown in FIG. 4, the neutral line P—P passes the axis of the pivotal shaft 21. A spring lug 16A is formed on the housing at a position on the neutral line. The holder 23 has a spring hook 23A at a position between the lug 16A and the shaft 21. An expansion spring 25 is engaged with lug **16*a* and hook 23A at both ends 25A and 25B. Accordingly, when the end 25B passes the neutral line P—P, the spring 25 is most compressed to produce a maximum spring force. Thus, the holder 23 is kept in abutment on stopper 18A or 18B**.

On the pivotal shaft 21, a start lever 26 is rotatably mounted. The start lever 26 has an arcuated extension 26X, a projection 26E adapted to be abutted on the periphery of the holder 23, and a pushing protrusion 26F for an operator's thumb. A spring 26B is provided between the housing 16 and a projection 26A opposite to the lever 26 to urge the lever away from the holder 23. The arcuated extension 26X is adapted to move along fixed contacts provided on an upper periphery of the holder, as described hereinafter.

Figure 10:
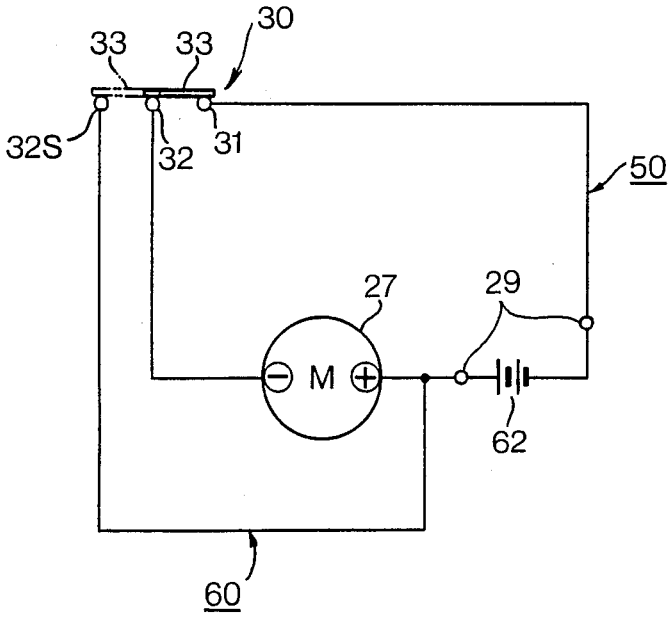
FIG. 10 is a circuit for the starting-motor.

Referring to FIG. 1, a starting motor 27 is mounted in the holder 23 and secured thereto by screws 27a. Secured to an output shaft 27B of the motor is a pinion 28 which is engaged with the ring gear 17 at a projected position corresponding to stopper 18B. The motor has a pin jack 29 for connecting to an external portable battery 62 (FIG. 10).

Referring to FIGS. 5 to 8, on the upper periphery of the holder 23, two first contacts 31, 32 and a second contact 32S are secured to projections 23Y, 23X, 23Z formed on the holder along an arc about the axis of the shaft 21. On the other hand, a third contact 33 comprising a pair of protrusions of a conductive plate is secured to the inside of the extension 26X of the start lever so as to engage with two of contacts 31, 32 or 32, 32S to form a switch mechanism 30. As shown in FIG. 10, contacts 31 and 32 are provided to connect a motor starting circuit 50, and the contacts 32 and 32S are provided to close a regenerative braking circuit 60.

The two first contacts 31, 32 and a second contact 32S can be provided on the start lever 26, and the third contact 33 can be secured to the holder 23.

If the start lever 26 is operated to engage the pinion 28 with ring gear 17 after the start of the engine by an accident such as mistake of the operator or pressure on the lever by other things, the motor is driven at high speed by the ring gear 17, which will cause burning of the coil of motor or breakdown of the pinion. The starting device has a safety device 40 for avoiding such troubles. The safety device 40 comprises a solenoid 46*a* and a plunger casing 46 operated by the solenoid. The solenoid 46*a* is secured to the housing 16 by screws 42*a* through a bracket 42. A stopper 41 is provided in the plunger casing 46 so as to project in a course of an end 26S of the start lever 26 to prevent the lever from being moved to the starting position.

Figure 9:
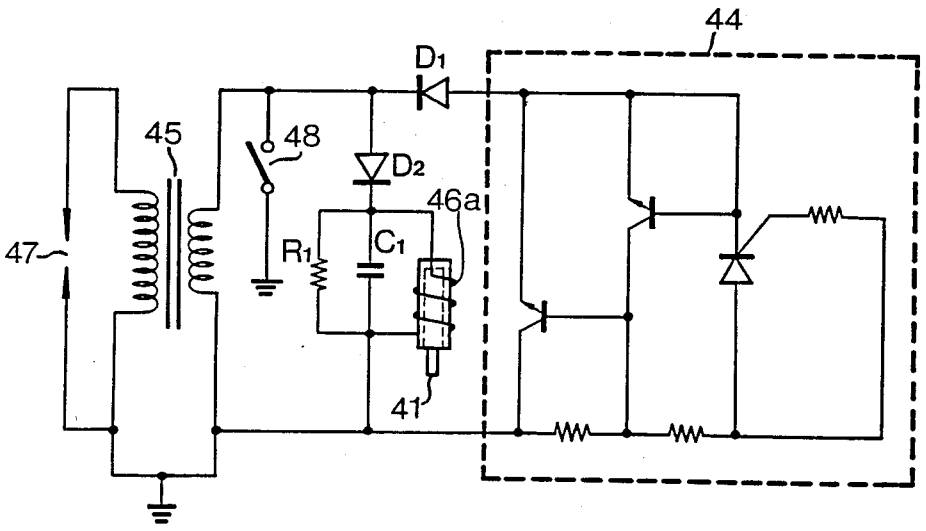
FIG. 9 is a circuit for a safety device.

Referring to FIG. 9, a spark plug 47 is connected to a secondary coil of an ignition coil 45, and primary coil is connected to an ignition timing control circuit 44 of magneto ignition system (not shown). The solenoid 46*a* is so connected as to be supplied with the current in the primary coil. Namely, the solenoid 46*a* is connected to the ignition circuit by way of diodes D1 and D2, and a capacitor C1 and resistor R1 are connected to the solenoid in parallel. A switch 48 is provided to stop the engine by shortcircuiting the circuit.

Figure 11:
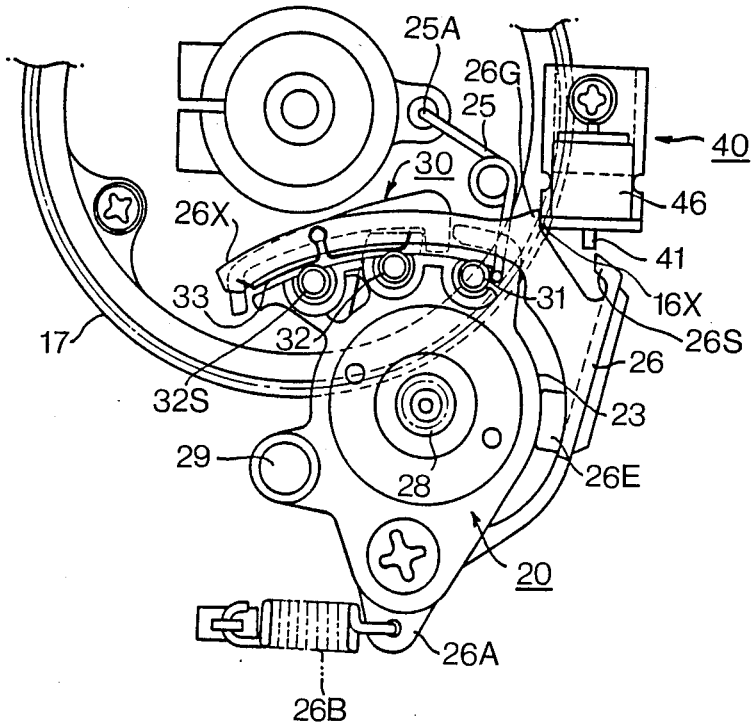
FIGS. 11 to 13 front views showing the starting operation.

The operation of the system is described hereinafter. In a stop of the engine, the starting motor unit 20 and the start lever 26 are at a home position shown in FIG. 11 and the solenoid 46*a* is de-energized to retract the stopper 41. The start lever 26 is urged by the spring 26B, so that a projection 26G of the lever is abutted on a stopper 16X formed on the bracket. The holder 23 engages with the stopper 18A (FIG. 3) by the force of the spring 25.

Figure 12:
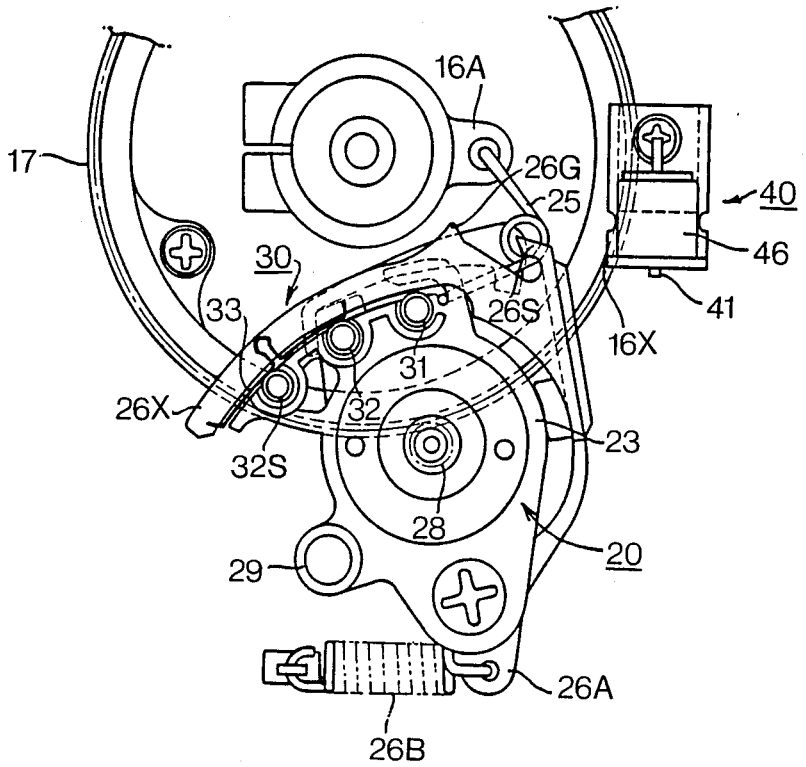
Figure 13:
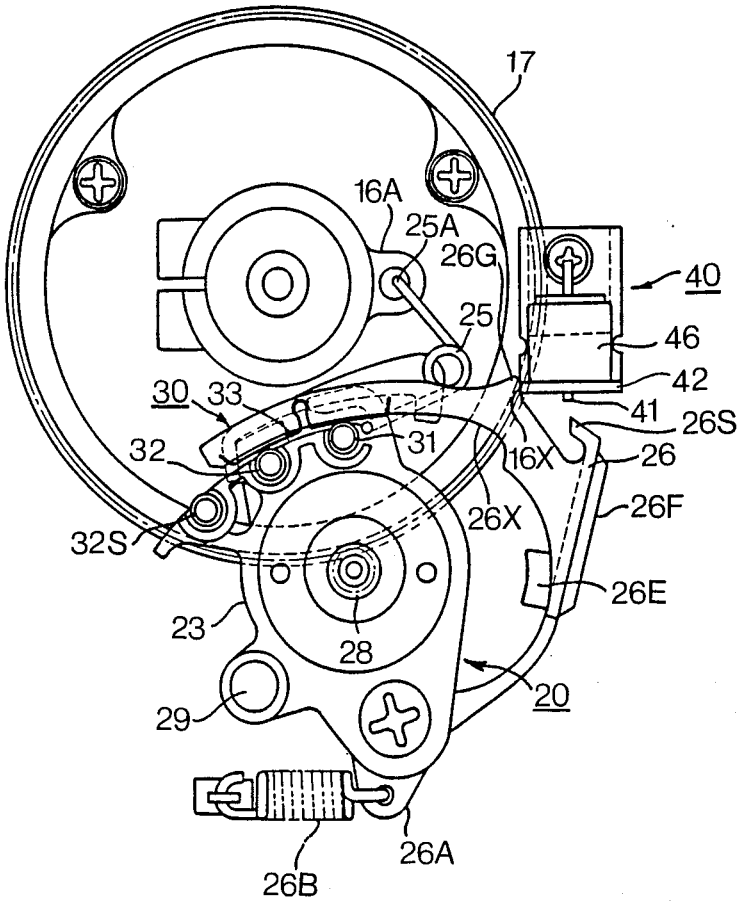

In order to start the engine, the battery 62 is connected to the motor starting circuit 50 by means of the pin jack 29, and the start lever 26 is pushed by the operator's hand to rotate the lever together with the holder 23 about the shaft 21. When the end 25B of the spring 25 passes the neutral line P—P, the holder 23 is rotated by the spring 25. Thus, the protrusion 22 of the holder abuts on the stopper 18B and the lever 26 is stopped by the holder (FIG. 12). At that position, the pinion 28 engages with ring gear 17 and the third contact 33 engages with first and second contacts 32 and 32S. Accordingly, the motor does not operate. When the lever 26 is released from the finger, the lever is rotated in the clockwise direction in FIG. 12 by means of the spring 26B and stopped at the stopper 16X (FIG. 13). In the state, third contact 33 engages with first contacts 31, 32 as shown in FIG. 10. Thus, the motor start circuit 50 is closed to drive the motor 27, thereby rotating the ring gear 17 to start the engine. When the engine is started, the reaction of the ring gear 17 causes the holder 23 to rotate in the clockwise direction about the shaft 21, passing the neutral line P—P. The holder 23 is stopped by the stopper 18A. When the engine is started, current flows in the primary coil of the ignition coil 45 (FIG. 9), so that the solenoid 46*a* is energized. Thus, the stopper 41 projects in the course of the end 26S of the start lever 26 at the front side thereof to obstruct the course (chain lines in FIG. 6). Accordingly, the start lever can not be rotated to the starting position, thereby preventing troubles after starting the engine.

On the other hand, the engine may stall immediately after starting the engine because of malfunction of a device such as a carbuletor. In such cases, the stopper 41 retracts upwardly because of no current to the solenoid and the engine is re-started. However, the pinion 28 rotated by the reaction of the ring gear 17 continues to rotate due to inertia. If the rotating pinion is engaged with the ring gear, the pinion may be broken down. In order to quickly brake the motor, the regenerative braking circuit 60 (FIG. 10) is provided. When the holder 23 returns to the home position of FIG. 11, the third contact 33 engages first and second contacts 32 and 32S as shown in FIG. 10 by chain lines to close the braking circuit. Thus, the motor acts as a generator. Accordingly, the rotor of the motor is stopped by the regenerative braking effect immediately after the closing of the circuit.

Figure 14:
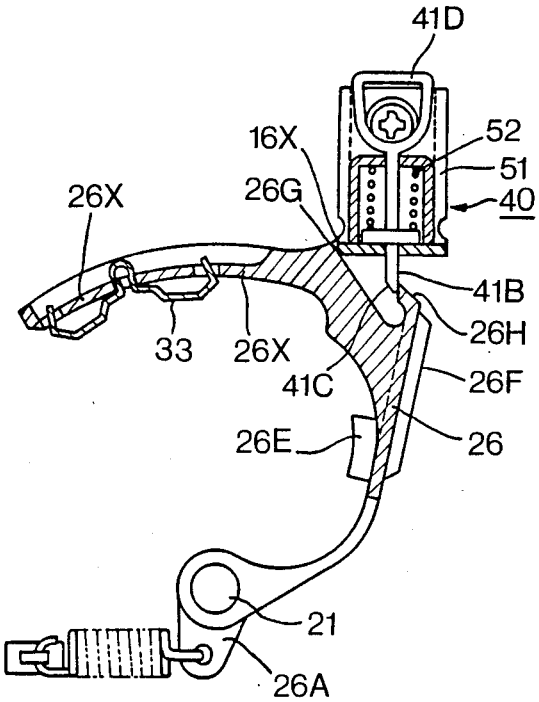
FIG. 14 shows another example of a safety device.

FIG. 14 shows another example of the safety device 40. The device has a stopper 41B urged by a spring 52 provided in a case 51. The stopper 41B has a grip 41D for lifting it, and a slant 41C co-operating with a slant 26H of the start lever 26.

Before the start lever 26 is pushed in order to start the engine, the stopper 41B is raised by the operator's hand. When the start lever returns to the home position, the slant 26H slides on the slant 41C to raise the stopper to permit the passing of the lever. At the home position, the stopper 41B obstructs the course of the lever.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A starting system for a small engine having a ring gear securely mounted on a crankshaft, comprising:

a holder rotatably mounted on a shaft;

a starting motor securely mounted in the holder;

a pinion secured to an output shaft of the starting motor, a start lever rotatably mounted on the shaft;

the holder being arranged to be rotated by an operator through the start lever from a home position to a starting position so as to engage the pinion with the ring gear;

means for resiliently holding the holder at the home position and the starting position;

a pair of first contacts provided on one of the holder and the start lever;

a third contact provided on another so as to engage with the first contacts;

an engine starting circuit including the first and third contacts, for connecting the motor with a source, the holder and the start lever being arranged to engage the third contact with the first contacts when the holder is at the starting position and the start lever is returned to the home position to close the engine starting circuit, whereby the starting motor is driven to start the engine.

2. The system according to claim 1 wherein the means is a first spring provided between the holder and a fixed position of a member of the engine, the first spring is arranged to urge the holder to the home position and to the starting position on both sides of a neutral line connecting the fixed position and the axis of the shaft.

3. The system according to claim 1 further comprising a second spring for urging the start lever to the home position.

4. The system according to claim 1 further comprising a safety device having a stopper provided to project to obstruct a course of the start lever to the starting position.

5. The system according to claim 4 wherein the safety device has a spring for urging the stopper to an obstructing position, and slants formed on the stopper and the start lever so as to permit the start lever to return to the home position.

6. The system according to claim 4 wherein the safety device has a solenoid which is energized by a current for an ignition system of the engine to project the stopper in the course.

7. The system according to claim 1 further comprising a second contact provided on the holder to engage with the third contact together with one of the first contacts when the holder and start lever are at the home position, thereby providing a regenerative braking circuit for the starting motor.

* * * * *